US006592775B1

(12) United States Patent
Skold

(10) Patent No.: US 6,592,775 B1
(45) Date of Patent: Jul. 15, 2003

(54) AQUEOUS METAL WORKING LIQUID

(75) Inventor: Rolf Skold, Stenungsund (SE)

(73) Assignee: AB Chem Dimension, Stenungsund (SE)

( * ) Notice: Subject to any disclaimer, the term of this patent is extended or adjusted under 35 U.S.C. 154(b) by 0 days.

(21) Appl. No.: 09/889,492

(22) PCT Filed: Jan. 13, 2000

(86) PCT No.: PCT/SE00/00036

§ 371 (c)(1),
(2), (4) Date: Jul. 18, 2001

(87) PCT Pub. No.: WO00/42136

PCT Pub. Date: Jul. 20, 2000

(30) Foreign Application Priority Data

Jan. 18, 1999 (SE) ..... 9900111

(51) Int. Cl.[7] ..... C09K 5/00

(52) U.S. Cl. ..... 252/73; 252/71; 252/79; 508/110; 508/431

(58) Field of Search ..... 252/73, 71, 79, 252/397; 508/110, 431

(56) References Cited

U.S. PATENT DOCUMENTS 4,564,461 A * 1/1986 Skold et al. ..... 508/430
4,976,919 A * 12/1990 Skold et al. ..... 508/437
5,622,923 A * 4/1997 Mathur et al. ..... 508/431
6,432,890 B1 * 8/2002 Skold ..... 508/431

FOREIGN PATENT DOCUMENTS

| | | |
|---|---|---|
| EP | A1-20822 | 10/1984 |
| EP | A1-405479 | 1/1991 |

* cited by examiner

*Primary Examiner*—Mark Kopec
*Assistant Examiner*—D G Hamlin
(74) *Attorney, Agent, or Firm*—Birch, Stewart, Kolasch & Birch, LLP

(57) ABSTRACT

The present invention relates to an aqueous metalworking liquid, which has the form of a clear solution at 20 ° C., is precipitated at a temperature higher than 20 ° C. and contains: (a) a polypropylene glycol compound containing 6–100 propyleneoxy groups and lacking the presence of hydrocarbons groups having more than 12 carbon atoms, and (b) at least one water-soluble anionic compound, selected from the group consisting of a phosphate ester or an ether carboxylate, the anionic compound containing 1–40 oxyalkylene groups having 2–4 carbon atoms and lacking presence of hydrocarbon groups with more than 12 carbon atoms. The metalworking liquid has excellent lubricating properties and can easily be worked up and reused without leaving troublesome coatings on the metal surfaces.

12 Claims, No Drawings

AQUEOUS METAL WORKING LIQUID

This application is the national phase under 35 U.S.C. § 371 of PCT International Application No. PCT/SE00/00036 which has an International filing date of Jan. 13, 2000, which designated the United States of America and was published in English.

Present invention relates to an aqueous metalworking liquid containing a non-ionic polypropylene glycol compound and an anionic compound, which is selected from the group consisting of a phosphate ester and an ether carboxylate, and contains alkyleneoxy groups. The metal working liquid has excellent lubricating properties and it can also easily be worked up and reused without leaving troublesome coatings on the metal surfaces.

Metal working operations are often performed in the presence of aqueous cooling lubricants containing ethanolamines, such as monoethanolamine, diethanolamine and triethanolamine, as a corrosion inhibitor. However, ethanolamines have a limited lubricating ability and cause in addition dissolution and/or discoloration of many metals, such as cobalt, copper and aluminium. The dissolved metals also constitute a troublesome environmental problem.

In order to diminish the negative effects of ethanolamines, anionic surfactants having long aliphatic groups, such as groups containing 14–44 carbon atoms, have been added. Example of such surfactants are phosphate esters, fatty acids and dimeric acids. Their protective effect depends on the formation of water-insoluble, organic layers on the metal surfaces. However, if dissolved di- or trivalent metal ions are present in the cooling lubricant, then the anionic surfactants and these metal ions will form water-insoluble salts. In some cases this could further increase the corrosion inhibiting effect, but it can also in other cases result in the formation of sticky precipitates, which for example make it more difficult to work up the cooling lubricant. Another disadvantage is the fact that the hydrophobic layers formed on the metal surfaces are difficult to remove. Unless they are removed they will cause problems in the subsequent operations, for example pickling, phosphatizing, galvanizing or other metal depositing processes. The presence of the long chain anionic components may also cause undesirable foaming and scum.

U.S. Pat. No. 4,315,889 discloses a method of reducing the release of cobalt by performing the metal working in the presence of a cooling lubricant containing, as an active component, a specific triazole or thiadiazole compound. However, since these active compounds are consumed in the presence of ethanolamines, the aqueous cooling lubricant has to be regularly upgraded.

EP-A-0180561 describes the use of a tertiary alkanol amine compound for reducing the release of cobalt. According to the application the tertiary alkanol amine compound can advantageously be combined with carboxylic acids for further protection against the release of cobalt and the corrosion of iron. Although this combination improves the properties of the cooling lubricant it is not a fully satisfactory solution on the earlier mentioned problems.

The aim of the present invention is to provide an aqueous metalworking liquid, which does not form precipitates that are sticky or difficult to remove from the metal working liquid. At the same time the metal working liquid must be easy to upgrade and to reuse, exhibit excellent lubricating and have good anti-corrosion ability.

Surprisingly, it has now been found that these aims can be met by an aqueous metalworking liquid, which has the form of a clear solution at 20° C., is in the form of a precipitate at a temperature higher than 20° C. and contains a) a non-ionic polypropylene glycol compound containing 6–100, preferably 10–50 propyleneoxy groups, and lacking the presence of hydrocarbon groups having more than 12 carbon atoms, and b) at least an aqueous anionic compound selected from the group consisting of a phosphate ester or an ether carboxylate, both of which containing 1–40 alkyleneoxy groups, preferably 4–20 alkyleneoxy groups, having 24 carbon atoms, and lacking hydrocarbon groups having more than 12 carbon atoms.

According to the invention it has been found that the polypropylene glycol compound and the anionic compounds co-operate in the metal working process, if the temperature of the metal working liquid exceeds the cloud point. Under this condition the compounds are precipitated together and a synergistically improved lubrication is obtained. Normally the cloud point is not over 60° C., preferably not over 40° C., since it is valuable to be able to perform the metal working processes at a low temperature and secure both excellent lubrication and effective cooling. Suitably, the contents of the polypropylene glycol compound and the anionic compounds are 0.2–5% by weight. The metalworking liquid can suitably be used in metal removing operations, such as drilling, milling, turning, grinding and thread forming, and in metal forming operations, such as rolling, deep drawing, press turning and thread forming.

The metalworking liquid according to the invention has a relatively high critical micelle concentration (CMC), which means that the contents of the lubricating components can be kept on a relatively high level without exceeding CMC. Contents below the CMC of the lubricating components also result in a low emulsification of leak oils from the working machine. The oils can easily be removed together with other water-insoluble impurities in a manner known per se at a temperature below the cloud point of the metal working liquid. Therefore, the metal working liquid preferably contains the lubricating components in a content of 50–100% by weight of CMC of the mixture at the working temperature of the liquid.

The working up of the metal working fluid can be done, for example by filtration or centrifugation. One suitable method is to filtrate the liquid through a hydrophilic regenerated cellulose membrane having a pore size letting through linear polymer compounds with molecular weights of below 100 000. The leak oil can usually be completely removed, if the pore size of the filter does not exceed 0.1 micrometer. Other suitable membranes are hydrophobic membranes made of organic fluoro polymers and hydrophilic membranes made of polysulphones or ceramic materials.

It is also possible to clean the liquid from water-soluble impurities, such as salts, by performing the cleaning process at a temperature above the cloud point of the liquid and remove at least a part of the water and the impurities dissolved therein from the precipitated lubricating compounds. Since the metalworking fluid can be effectively cleaned, the demand for biocides, corrosion inhibitors and complementary additions of lubricating compounds is reduced. At the same time the life time of the metal working fluid is prolonged and the environmental problems reduced.

Suitable polypropylene glycol compounds to be used in the metal working liquid are compounds of the formula $$RO(AO)_nH \quad (I),$$

in which R is hydrogen or a hydrocarbon group having 1–12 carbon atoms, preferably 1–8 carbon atoms, AO is an alkyleneoxy group having 2–3 carbon atoms, at least 50% of all the alkyleneoxy groups being propyleneoxy groups, and n is a number from 6–100, preferably from 10 to 50. Preferred polypropylene glycol compounds are polypropylene glycol having a molecular weight of 700–3 000 and glycol compounds having a molecular weight of 750–4 000, containing both ethyleneoxy groups and propyleneoxy groups, and in which R in formula I is hydrogen.

The phosphate ester, which also has anti-corrosion properties, suitably consists of compounds of the formula $$R_1(\text{oxyalkylene})_pOP(O)(X)(OH) \quad \text{(II), or}$$

$$(HO)_2(O)P\text{-}(\text{oxyalkylene})_q\text{—}OP(O)(OH)_2 \quad \text{(III),}$$

in which $R_1$ is an alkyl group having 1–12 carbon atoms, oxyalkylene is a group having 2–4 carbon atoms, p is a number from 1–20, preferably 4–15, X is hydroxyl, $R_1O$ or $R_1(\text{oxyalkylene})_nO$, where $R_1$, oxyalkylene and n have the meanings mentioned above, and q is a number from 4–40, preferably 5–20; or a preferably monovalent salt thereof. The $(\text{oxyalkylene})_p$ group and the $(\text{oxyalkylene})_q$ group in the phosphate esters of formula II and formula III, respectively, are suitably chosen in such a manner that the phosphate esters become water-soluble in water of 20° C. The aliphatic group $R_1$ can be saturated or unsaturated, straight or branched and contains preferably 2–8 carbon atoms. The phosphate esters of formula II preferably consist of at least 50% by weight of monoesters. In formula III the poly(oxyalkylene) chain preferably consists at least partially of oxyalkylene groups having 3–4 carbon atoms and q is at least 5, since these diphosphate esters apart its lubricating effect also give an essential anti-corrosion contribution. Those diphosphate esters containing a poly(oxypropylene) chain having 8–15 oxypropylene groups are particular suitable.

The ether carboxylate, which also has a considerable corrosion inhibiting ability, consist preferably of compounds of the formula $$R_5O(AO)_rC_2H_4COOH \quad \text{(IV),}$$

in which R5 is a hydrocarbon group having 1–12 carbon atoms, preferably 2–8 carbon atoms, AO is an alkyleneoxy group having 2–3 carbon atoms and r is a number from 1–15; or a preferably monovalent salt thereof.

The total content of the polypropylene glycol compound and the anionic compounds can vary within wide limits but it is normally between 0.5 and 8% by weight, preferably between 1 and 7% by weight of the metalworking liquid ready to use. The weight ratio between the polypropylene glycol compound and the anionic compounds is normally between 1:10 and 5:1. The amount of water is usually from 75–99.5% by weight. The liquid can also contain a number of other additives, such as additional corrosion-inhibiting additives and lubricants, pH-regulating or pH-controlling agents, bactericides, viscosity-increasing additives, solubilizers, perfumes, colourants etc.

Examples of suitable additional corrosion inhibitors, which also give a certain contribution to the lubricating ability, are inorganic compounds, such as alkali metal hydroxides and boric acids; and reactions products between boric acid and/or carboxylic acids and organic compounds, such as alkanol amines; or alkenyl succinic acids or salts thereof. Example of suitable alkenyl groups are octenyl, decenyl, di(isobutenyl) and tri(propenyl). The content of these additional corrosion inhibitors can be up to 3% by weight of the metal working liquid.

The solubilizers are usually low molecular weight compounds containing at least one hydroxyl group and are primarily used to regulate cloud point of the metal working liquid in a concentrate, but they may also be used to adapt the liquid after the temperature conditions existing during the metal working. The molecular weights of the solubilizers are normally below 400 and common examples are propylene glycol, methyl dipropylene glycol, ethyl diethylene glycol, butyl diethylene glycol and butyl triethylene glycol.

When preparing a metalworking liquid according the invention, it is suitable to first prepare a concentrate, for example by first mixing the polypropylene glycol compound, the anionic compounds and water, and then the supplementary ingredients. The amount of water is suitably 5–80% by weight of the concentrate. A typical concentrate according to the invention has the following composition in % by weight:

polypropylene glycol compound+anionic compound 20–95, preferably 50–90% additional corrosion inhibitor 0–30, preferably 0–20% water 5–80, preferably 10–50% other ingredients 0–30, preferably 0–20%

The total amount of the additional corrosion inhibitor and the other ingredients is often 5–30% by weight of the concentrate. Before the concentrate is used, it is diluted with water so that the metalworking liquid ready for use will contain 0.5–5% by weight, preferably 1–7% by weight of the total amount of the polypropylene glycol compound and the anionic compounds.

The present invention is further illustrated by the following working examples. In these examples the following symbols are used:

PPG 900=polypropylene glycol of the molecular 900

PPG 1 800=polypropylene glycol of the molecular weight 1 800

Ph1=$C_6H_{13}(OC_2H_4)_5OPO(OH)_2$

Ph2=$C_6H_{13}(OC_3H_6)_4OPO(OH)_2$

Ph3=n-butyl$(OC_3H_6)_{10}OPO(OH)_2$

EC=$C_xH_{2x+1}(C_2H_4O)_nC_2H_4COOX$, in which x=2–22 and n=1 and 8

OCSA=octenyl succinic acid

TEA=triethanolamine

TED=triethanolamine+6 propylene oxide

EXAMPLE 1

The lubricating ability of some different aqueous metalworking liquids containing PPG-900 and Ph1 and Ph2 or Ph3 and sometime OSCA was tested at 25° C. in the reservoirs of the liquids and compared with the lubricating ability of the individual components. The temperature in the reservoirs is below the cloud points of the liquids. The metalworking fluids were prepared by dissolving the active components in water of 4,7°dH, whereupon pH was adjusted to 9 by adding KOH. The lubricating ability of the different liquids was determined by measuring the wear scar obtained after 2 minutes with a modified Timken-machime using steel-rings and steel-cylinders of the quality A4138 and the outer diameter of 35 mm. The following results were obtained.

TABLE 1

| Test | Formulation | Wear scar, mm |
|---|---|---|
| | Lubricating ability | |
| 1 | 2% PPG-900 | 1.03 |
| 2 | 2% Ph1 | 1.28 |
| 3 | 2% Ph3 | 0.83 |
| 4 | 2% OCSA | 0.97 |
| 5 | 1% PPG-900; 1% Ph1 | 1.01 |
| 6 | 1% PPG-900; 1% Ph3 | 0.83 |
| 7 | ⅔% PPG-900; ⅔% Ph1; ⅔% OCSA | 0.93 |
| 8 | ⅔% PPG-900; ⅔ Ph3%; ⅔% OCSA | 0.90 |

From the results, it is evident that the formulations according to the invention in tests 5–8 exhibit a synergistic lubricant effect. Especially evident is positive effect between PPG-900 and Ph1.

EXAMPLE 2

A number of metalworking liquids with a composition according to the invention were prepared by adding the components according to Table 2 to water of 4.7°dH. Their lubricating ability was compared with formulations, where the anionic components had been replaced with PPG-1800. The lubrication tests were performed in the same manner as in Example 1. The following results were obtained.

TABLE 2

| Tests | Formulation | Wear scar, mm |
|---|---|---|
| | Lubrication ability | |
| 1 | 0.6% Ph1; 0.25% PPG-1800; 1% TEA | 1.03 |
| 2 | 0.6% Ph2; 0.25% PPG-1800; 1% TEA | 1.47 |
| 3 | 0.6% EC; 0.25% PPG-1800; 1% TEA | 1.70 |
| 4 | 0.6% Ph1; 0.25% PPG-900; 1% TEA | 1.23 |
| A | 0.85% PPG-1800; 1% TEA | 1.83 |
| B | 0.85% PPG-900; 1% TEA | 1.87 |

The results show that the formulations in tests 1–4 have essential better lubricating ability than the comparison formulations in the tests A and B.

EXAMPLE 3

A lubricant concentrate, containing 10% Ph1, 5% PPG 1 800, 10% butyl diethyleneglycol, 10% isononanoic acid, 20% TED and 45% water, was diluted with water in a ratio of 1:20, whereupon KOH was added to adjust the pH of the solution to 9. The solution had a cloud point of 23° C. Dodecane in an amount of 1 % by weight of the solution was added to the solution as a model leak oil, whereupon the temperature was set at 18° C. This mixture containing emulsified dodecane was then filtered through a polysulphone membrane having a pore size of 0.01 micrometer. The permeate was substantially free from leak oil (less than 5 ppm), while the active content of the original solution was essentially not effected.

This test shows how easy it is to upgrade a lubricant according to the invention.

What is claimed is:

1. An aqueous metalworking liquid, which has the form of a clear solution at 20° C. and contains, precipitated at a temperature higher than 20° C. and contains a) an non-ionic polypropylene glycol compound having 6–100 propyleneoxy groups and lacking hydrocarbon groups having more than 12 carbon atoms and b) at least one water-soluble anionic compound, selected from the group consisting of a phosphate ester or an ether carboxylate, the anionic compound containing 1–40 oxyalkylene groups having 2–4 carbon atoms and lacking the presence of hydrocarbon groups having more than 12 carbon atoms.

2. The liquid according to claim 1, wherein the polypropylene glycol compound has the formula $RO(AO)_nH$ (I), in which R is hydrogen or a hydrocarbon group having 1–12 carbon atoms, AO is an alkyleneoxy group having 2–3 carbon atoms,. at least 50% of all alkyleneoxy groups being propyleneoxy groups. And n is a number from 6–100.

3. The liquid according to claim 2, wherein the polypropylene glycol compound is a polypropylene glycol with a weight average molecular weight of 700–3000.

4. The liquid according to claim 1, wherein the phosphate ester has the formula $R_1(\text{oxyalkylene})_p$ OP(O) (X) (OH) (II), or $(HO)_2(O)$ P-$(\text{oxyalkylene})_q$-OP(O) $(OH)_2$ (III), in which $R_1$ is an alkyl group having 1–12 carbon atoms, oxyalkylene is a group having 2–4 carbon atoms, p is a number from 1–20, X is hydroxyl, $R_1O$ or $R_1$ $(\text{oxyalkylene})_nO$, where $R_1$, oxyalkylene and n have the meanings mentioned above, and q is a number from 4–40; or a salt thereof.

5. The liquid according to claim 4, wherein the phosphate ester of the formula II consists of at least 50% of a monoester, $R_1$ is an alkyl group having 2–8 carbon atoms, the oxyalkylene group contains 2–3 carbon atoms and p is a number from 3–15.

6. The liquid according to claim 4, wherein the oxyalkylene group in the phosphate ester of formula III consist of a least 50% of oxlyalkylene groups having 3–4 carbon atoms and that q is a number from 5–20.

7. The liquid according to claim 1, wherein the ether carboxylate has the formula $R_5O(AO)_rC_2H_4COOH$ (IV), in which $R_5$ is a hydrocarbon group having 1–12 carbon having 1–12 carbon atoms, preferably 2–8 carbon atoms, AO is an alkyleneoxy group having 2–3 carbon atoms, and r is a number from 1–15.

8. The liquid according to claim 1, comprising, 0.2–5% by weight the polypropylene glycol compound and 0.2–5% by weight of the anionic compound.

9. A aqueous metalworking concentrate, comprising a polypropylene glycol compound and an anionic compound as defined in claim 1, in a total amount of 20–95% by weight, additional corrosion inhibitors in an amount of 0–30% by weight, water in an amount 5–80% by weight and other ingredients in an amount 0–20% by weight.

10. The concentrate according to claim 9, comprising the polyprolpylene glycol compound and the anionic compound in an total amount of 50–90% by weight, the additional corrosion inhibitors in an amount of 0–20% by weight, water in an amount of 10–50% by weight and the other ingredients in an amount of 0–20% by weight, the content of additional corrosion inhibitors and other ingredients being 5–30% by weight.

11. The concentrate according to claim 9, wherein the polypropylene glycol compound has the structure as defined in claim 12 and the anionic compound as defined in claim 4.

12. The concentrate according to claim 9, wherein the polypropylene glycol compound has the structure as defined in claim 2, and the anionic compound as defined in claim 7.

* * * * *